US006010462A

United States Patent [19]

Stoermer, III

[11] Patent Number: 6,010,462

[45] Date of Patent: Jan. 4, 2000

[54] BLISTER STYLE CULTURE TRANSPORT DEVICE AND METHOD FOR USING THE SAME

[75] Inventor: Ralph T. Stoermer, III, Pylesville, Md.

[73] Assignee: Becton Dickinson and Company, Franklin Lakes, N.J.

[21] Appl. No.: 09/086,052

[22] Filed: May 28, 1998

[51] Int. Cl.[7] ..... A61B 10/00

[52] U.S. Cl. ..... 600/572; 206/210; 206/363; 206/461

[58] Field of Search ..... 600/562, 569, 600/572; 604/1, 2, 3; 206/210, 361, 362, 363, 461, 471, 473

[56] References Cited

U.S. PATENT DOCUMENTS

| | | | |
|---|---|---|---|
| 3,748,098 | 7/1973 | Dutch | 23/253 R |
| 3,759,375 | 9/1973 | Nappi | 206/63.2 R |
| 3,776,220 | 12/1973 | Monaghan | 128/2 W |
| 3,835,834 | 9/1974 | Brown et al. | 600/572 |
| 3,910,410 | 10/1975 | Shaw | 206/363 |
| 3,967,730 | 7/1976 | Driscoll et al. | 206/461 |
| 4,211,323 | 7/1980 | Olsen | 206/210 |
| 4,498,796 | 2/1985 | Gordon et al. | 401/132 |
| 4,838,851 | 6/1989 | Shabo | 604/1 |
| 4,887,994 | 12/1989 | Bedford | 604/1 |
| 4,903,708 | 2/1990 | Saint-Amand | 128/749 |
| 4,938,462 | 7/1990 | Gould | 206/470 |
| 4,952,204 | 8/1990 | Korteweg | 604/1 |
| 5,147,035 | 9/1992 | Hartman | 206/45.23 |
| 5,238,649 | 8/1993 | Nason | 422/58 |
| 5,301,807 | 4/1994 | Donahue | 206/370 |
| 5,401,100 | 3/1995 | Thackston et al. | 374/208 |
| 5,404,693 | 4/1995 | Giovannone | 53/453 |
| 5,418,022 | 5/1995 | Anderson et al. | 428/35.2 |
| 5,623,942 | 4/1997 | Pestes et al. | 128/759 |
| 5,627,071 | 5/1997 | Triva | 435/307.1 |

*Primary Examiner*—Cary O'Connor
*Assistant Examiner*—Charles Marmor, II
*Attorney, Agent, or Firm*—David W. Highet, Esq.

[57] ABSTRACT

A resealable blister-type package, and method for using the same for storing and transporting a sample collecting device that is used to gather a biological sample, are disclosed. The package includes a tray-like enclosure having two cavities therein, and a resealable cover that covers the openings to the cavities. A sample collecting device, such as a swab, is stored in one of the cavities. The resealable cover is opened to remove the swab to collect the sample, and the used swab is reinserted into the other cavity of the package. The cover is then reattached over the openings of the cavities to reseal the cavities so that the package is ready for storage and transport. The package can alternatively include only one cavity that is used to store the swab in its unused and used condition. A medium can be disposed in the cavity in which the used swab is stored, or in a separate cavity that is in communication with the used swab storage cavity by a breakable seal. The enclosures can further include hinged sections to allow easier access to the cavities.

19 Claims, 15 Drawing Sheets

BLISTER STYLE CULTURE TRANSPORT DEVICE AND METHOD FOR USING THE SAME

BACKGROUND OF THE INVENTION

1. Field of the Invention

The present invention relates to a resealable package, in particular, a blister-type package, for storing and transporting at least one sample gathering device, such as a sterile swab for collecting biological or chemical specimens.

2. Description of the Related Art

It is often necessary for medical personnel to obtain biological samples from a patient for diagnostic purposes. For instance, if a patient is suffering from a sore throat, it is common for a physician to order a "throat culture" in which a sample of the mucous or fluid in the patient's throat is collected and analyzed to detect the presence of certain bacteria that may be causing the infection. Also, if a patient is suffering from a wound or vagina infection, a physician may request that a specimen be collected from the patient. Such throat or tract samples are commonly obtained by rubbing a sterile swab, such as a Dacron or rayon against the infected area so that some fluid or mucous adheres to the swab. The-swab on which the sample has been collected is then placed in a container, and sent to a laboratory for analysis.

Prior to use, the sterile swabs can be stored in their own individual sterile containers, such as a plastic tube, foil pouch or the like. When a swab is to be used, the package is opened and the swab is removed. The swab is used to collect the specimen, and can then be placed in another package containing a transport medium, such as a Stuart's medium, modified Stuart's medium, Amies media, or the like, which maintains microorganisms viable. The package containing the used swab and medium can then be sealed and forwarded to the laboratory for testing.

Another type of package, such as that described in U.S. Pat. No. 3,910,410 to Shaw, contains the sterile unused swab, and can be used to store and transport the swab after the swab has been used to collect the sample. This type of package includes a plastic tray containing a cavity in which a single or double swab is stored. The cavity is covered by a material, such as a laminate, plastic or the like, which is attached to the tray containing the cavity by an adhesive. When the swab is to be removed for use, the cover is peeled back and the swab is taken out of the cavity and applied to the infected area of the patient as described above. The used swab is then placed back into the cavity, and the lid is sealed back over the cavity. The adhesive material allows the lid to be peeled back to expose the cavity, and to then be reattached to the tray to cover the cavity. The cavity also includes a medium which maintains the bacteria on the collected sample. However, because the same cavity which includes the medium stores the swab in its unused condition, some of the medium could potentially adhere to the swab and thus be transferred to the patient and/or make the swab difficult to remove from the cavity.

Other types of packages are available which store the medium in an area that is separated from the swab cavity by a breakable medium. After the swab has been inserted into the cavity, the breakable medium is fractured by the insertion of the swab (or manually by an operator) to release the medium into the swab cavity. Packages of this type are described in U.S. Pat. No. 3,776,220 to Monaghan and U.S. Pat. No. 4,211,323 to Olsen. Some of these types of packages may contain a seal which isolates the cavity containing the tip of the swab from the cavity containing the remainder (e.g., the handle) of the swab, to prevent the medium from leaking into the entire swab cavity and thus contaminating the shaft of the swab. However, these types of packages are typically not designed to accommodate multiple swabs, or to apply multiple media to a single swab.

Accordingly, a continuing need exists for a resealable package for storing and transporting swabs that provides isolation between the swab and the medium prior to use, eliminates the need for performing a second manual operation (e.g., breaking a seal) after reinserting the used swab to provide the medium to the swab and specimen, prevents the medium from contaminating the swab handle after a sample has been taken, and allows for the use of multiple swabs and/or multiple media.

SUMMARY OF THE INVENTION

An object of the present invention is to provide a resealable package having independent cavities for storing a sampling device, such as a sample collecting swab, in its unused and used condition, respectively.

Another object of the invention is to provide a resealable package for storing a plurality of sample collecting swabs, and for providing a medium to at least one of the swabs.

A further object of the invention is to provide a resealable package for storing a sample collecting swab and providing multiple types of media to the swab.

A still further object of the invention is to provide a resealable package having a hinged portion which improves the resealing ability of the package and allows for easier removal and reinsertion of the sample collecting swab.

These and other objects of the invention are substantially achieved by providing a blister-type resealable package comprising a blister-type tray-like enclosure having first and second cavities which are accessible by at least one opening in the enclosure. A sterile unused swab is stored in one of the cavities. A resealable cover is attached over the opening or openings to seal the cavities and thus maintain a sterile environment for the cavities and the swab stored in one of the cavities. During use, the resealable cover can be peeled back to expose an opening through which the swab can be removed from the cavity. After the swab has been used to collect the biological sample, the swab is inserted into the other cavity, which contains a medium. The resealable cover is then reattached over the openings to maintain the used swab in the second cavity.

Another embodiment of the invention provides a resealable blister-type package of the type described above, with the tray-like enclosure including a hinged portion which allows a section of the enclosure to pivot about the hinged portion with respect to the remainder of the enclosure. The hinged portion includes the opening or openings which provide access to the cavities. The cover covers the openings and is releasably attached to the remaining portion of the enclosure. This arrangement allows for easier access to the cavities for removal and reinsertion of the sample collecting swab.

A further embodiment of the invention is similar to that described above in that it includes a hinged section of the enclosure. However, this embodiment includes only a single cavity for storing the sample collecting swab in its unused sterile condition and also in its used condition. The enclosure further includes a cavity containing a medium, such as a Stuart's medium or the like, which is separated from the swab storing cavity by a rupturable seal. When the used swab is returned to the swab storing cavity, and the resealable cover is reattached over the opening in the cavity, the rupturable seal can be broken to allow the medium to flow into the swab storing cavity. The swab storing cavity further includes indentations which form a well about the tip of the swab, to thereby retain the medium around the tip of the swab and prevent the medium from flowing over the handle of the swab. This embodiment can further include multiple cavities for storing multiple swabs, and multiple media cavities for providing multiple media to any of the swabs.

BRIEF DESCRIPTION OF THE DRAWINGS

These and other objects and advantages of the present invention will be more readily appreciated from the following detailed description taken in conjunction with the accompanying drawings, in which.

DETAILED DESCRIPTION OF THE PREFERRED EMBODIMENTS

Figure 1:
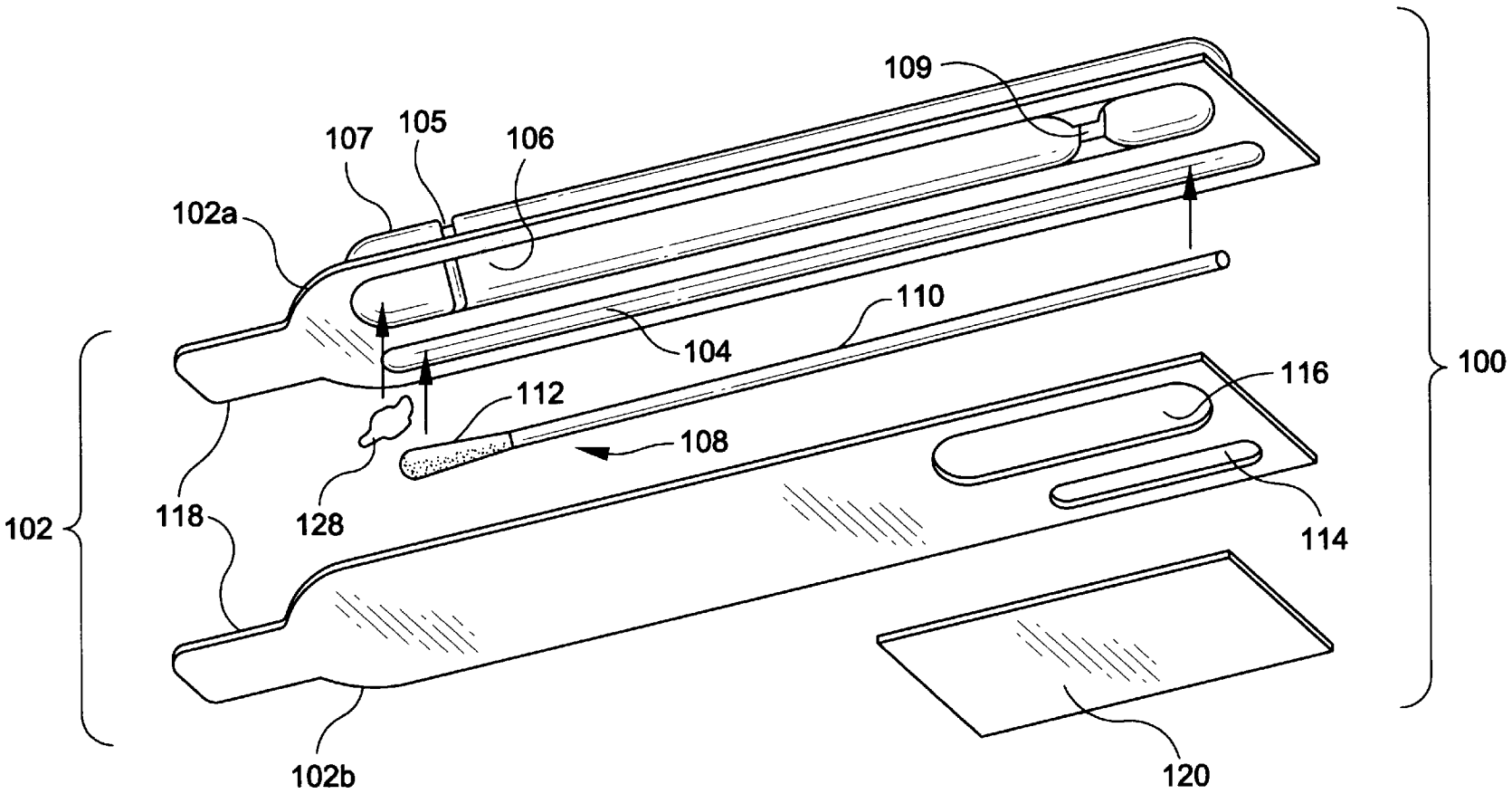
FIG. 1 is an exploded perspective view of a two-cavity resealable package for storing a sample collecting swab according to a first embodiment of the present invention.

An example of a resealable blister-type package according to an embodiment of the present invention is shown, in particular, in FIGS. 1–5. Specifically, the package 100 includes an enclosure 102 made of a blister-type material such as plastic or the like. The enclosure 102 includes a tray-like upper portion 102*a* having a narrow cavity 104 and a wide cavity 106 which, as discussed below, are formed in the upper portion 102*a* by a stamping process or the like. The wide cavity 106 is wider than the narrow cavity 104 as shown. For reasons described below, the upper portion 102*a* further includes a notched portion 105 which projects into the wide cavity 106, and a slanted portion 107. The upper portion 102*a* further includes a narrowed portion 109, which projects into and thus narrows a section of the wide cavity 106. The enclosure 102 further includes a lower portion 102*b*,which is made of a material similar or identical to that of upper portion 102*a*,and is attached to upper portion 102*a* by heat sealing or by an adhesive material.

As illustrated, a sample collecting device, in particular, a sample collecting swab 108 having a shaft 110 and a swab area 112, made of Dacron, rayon, or the like, is initially stored in the narrow cavity 104 as will be described in more detail below. The swab 108 is typically about 6 inches long or less, but can have any practical length suitable for use with the package 100. Openings 114 and 116 in the enclosure 102 provide access to the cavities 104 and 106, respectively. Furthermore, the enclosure 102 includes a narrow end portion 118 whose width is less than the width of the remainder of the enclosure 102. The narrow end portion 118 is dimensioned so that it can be inserted into, for example, the openings in a test tube tray or the like, for convenient storage of the package 100. Typically, the package 100 has a width of about 1.0 to 1.25 inches, and an overall length of about 6.5 inches, including the narrow end portion 118, which has a length of about 0.5 inches to about 0.75 inches and a width of about 0.630 inches. However, the overall package 100 and narrow end portion 118 can have any practical length and width.

As further illustrated, the package 100 includes a resealable cover 120 that is removably attached to the enclosure 102 by an adhesive or the like. The resealable cover 120 covers at least the portion of the enclosure 102 including openings 114 and 116, to thereby prevent access to cavities 104 and 106. Also, a pledget 128, made of an adsorbing material such as Dacron, rayon or the like, is disposed within cavity 106 and includes one or more media, such as Stuart's medium, modified Stuart's medium, Amies media, or the like, for purposes described below. The pledget 128 can be inserted dry, and medium can be dispensed on the pledget 128 during manufacture of the package 100. The pledget 128 can also be heat sealed (tacked) into the cavity 106, or held in place by an adhesive. The notched portion 105 of the upper portion 102*a* contains the medium around pledget 128 during the manufacturing process as described with regard to FIGS. 6 and 7 below, and also keeps the pledget 128 from being pulled out of cavity 106 with swab 108 when the swab 108 is removed from cavity 106.

Although the package 100 is shown as having one wide cavity 106 and one narrow cavity 104, the package can have multiple wide cavities 106 for storing medias and multiple narrow cavities 104 for storing multiple swabs 108.

Figure 6:
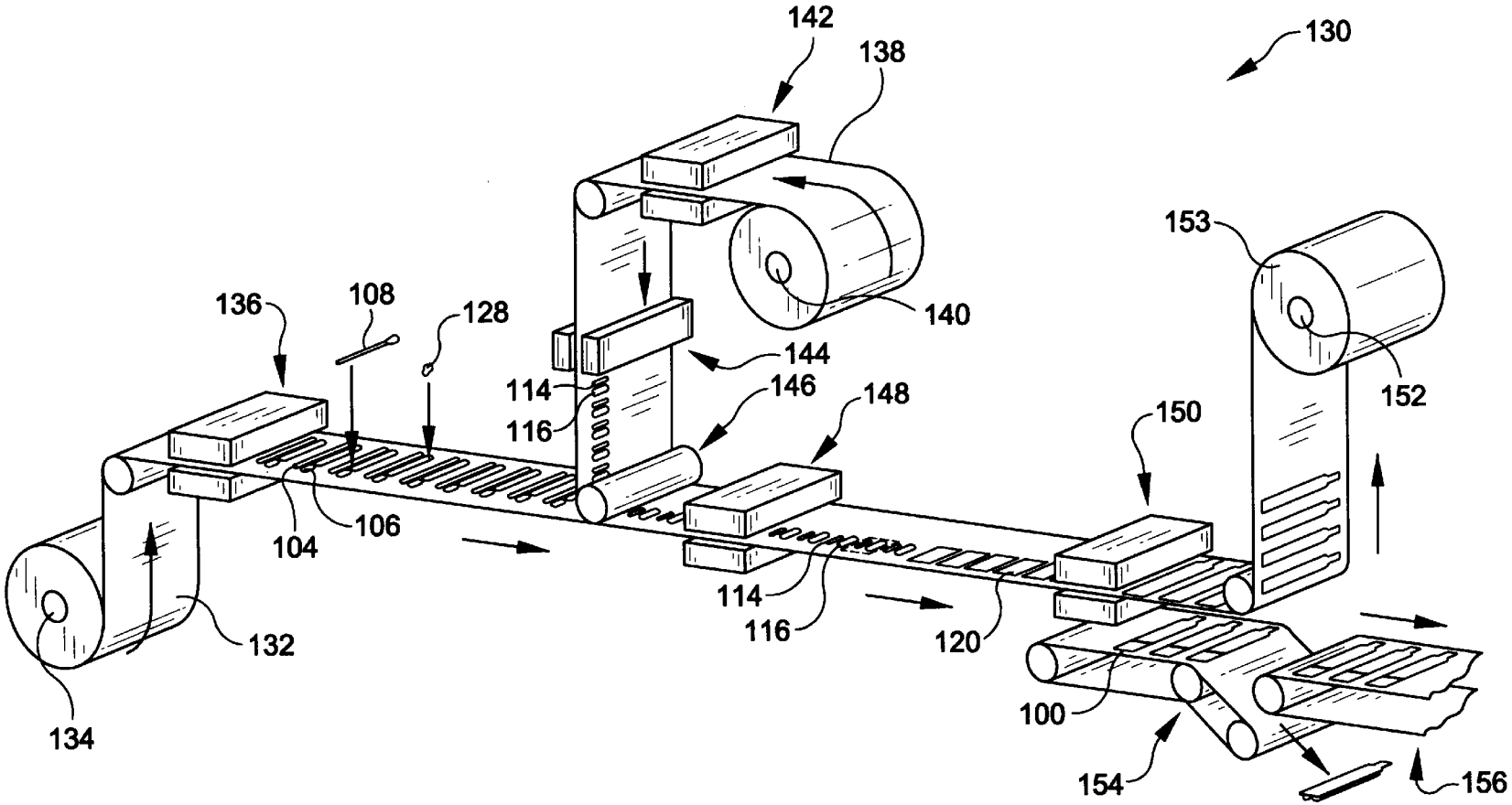
FIG. 6 illustrates an example of an apparatus for manufacturing a resealable blister-type package as shown in FIG. 1.

The package 100 shown in FIG. 1 can be manufactured by an apparatus 130 as shown in FIG. 6. Specifically, a roll of blister web 132 is placed on a roller 134 and is fed from roller 134 to a forming station 136 which forms pairs of cavities 104 and 106 in the blister web 132 as indicated. As the blister web 132 is being conveyed, a swab 108 is inserted into the cavity 104 of each pair of cavities 104 and 106, and a pledget 128 is inserted into the cavity 106 of each pair of cavities 104 and 106.

Similarly, a roll of blister backing web 138 is conveyed from a roller 140 through a printing (coding station 142 where information pertaining to each individual package 100 is printed on the blister backing web 138. The blister backing web 138 is then fed through a blister backing punch station 144 where pairs of openings 114 and 116 corresponding to each pair of cavities 104 and 106 are punched.

The blister backing web 138 is laid over the blister web 132 at a rolling station 146 such that each pair of openings 114 and 116 is disposed over a corresponding pair of cavities 104 and 106 in the blister web 132. The blister web 132 and overlaid blister backing web 138 are then conveyed to a blister seal station 148 where the blister backing web 138 is joined to the blister web 132 by heat sealing or the like. The sealed blister web 132 and blister backing web 138 are then conveyed to an area where the resealable cover 120 is attached over each pair of openings 114 and 116.

The combined blister web 132, blister backing web 138 and covers 120 are conveyed to a punch station 150 where the individual packages 100 are punched out of the combined blister web 132 and blister backing web 138 as indicated. The scrap portion of the blister web 132 and blister backing web 138 is conveyed onto a roller 152 as a scrap take-up roll 153, while the packages 100 are conveyed on a conveyor 154. Any defective packages 100 are conveyed to a reject pile (not shown), while acceptable packages 100 are conveyed to a system output conveyor 156 where they are packaged for sterilization prior to final release and shipment to customers, such as medical institutions and the like. Typically, the packages 100 are sterilized by electron beam sterilization or, preferably, gamma irradiation. However, any practical method of sterilization can be used.

Figure 7:
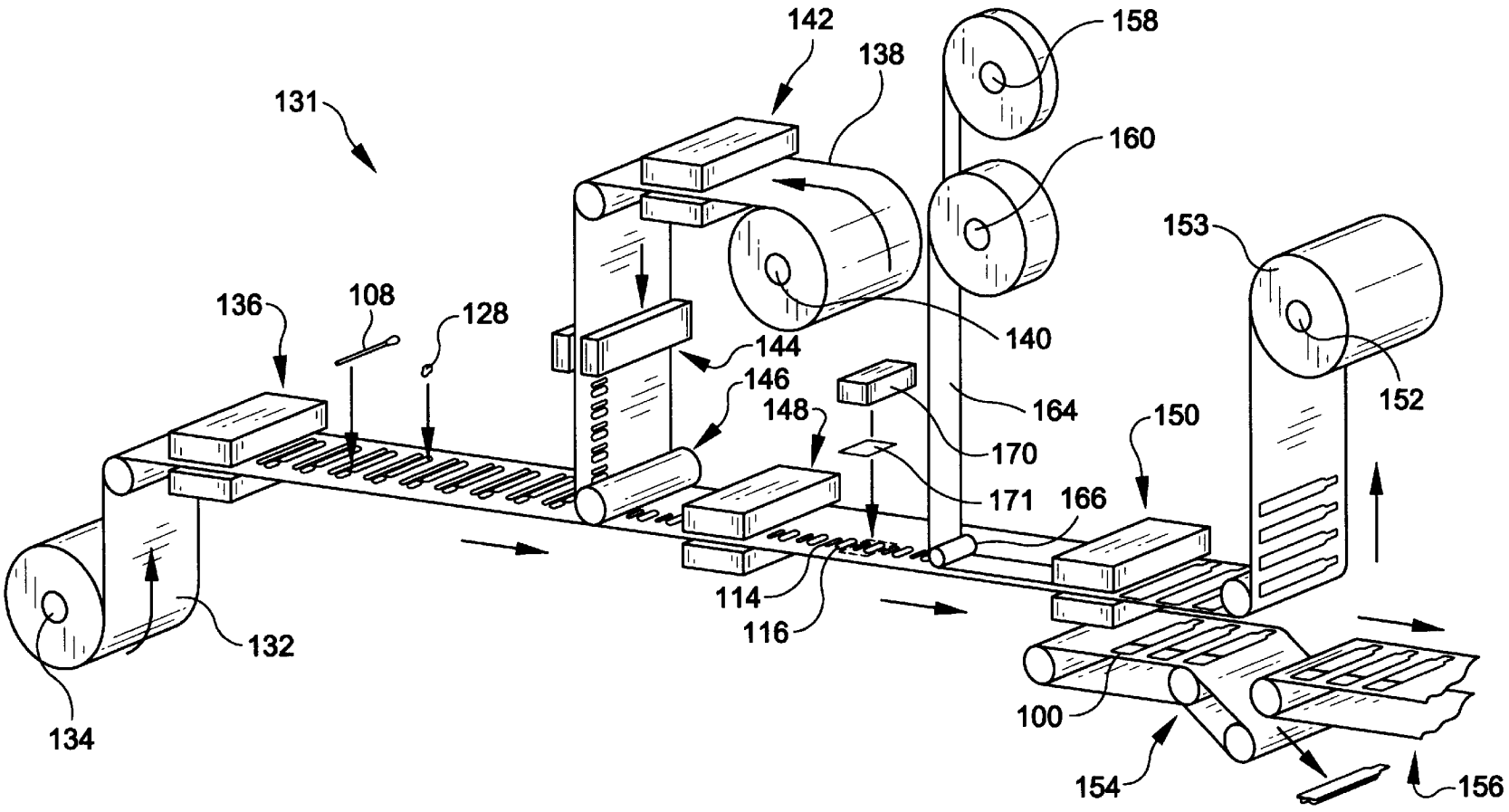
FIG. 7 illustrates a modification to the apparatus shown in FIG. 6, which provides an alternate method of attaching the covers to the resealable packages.
Figure 8:
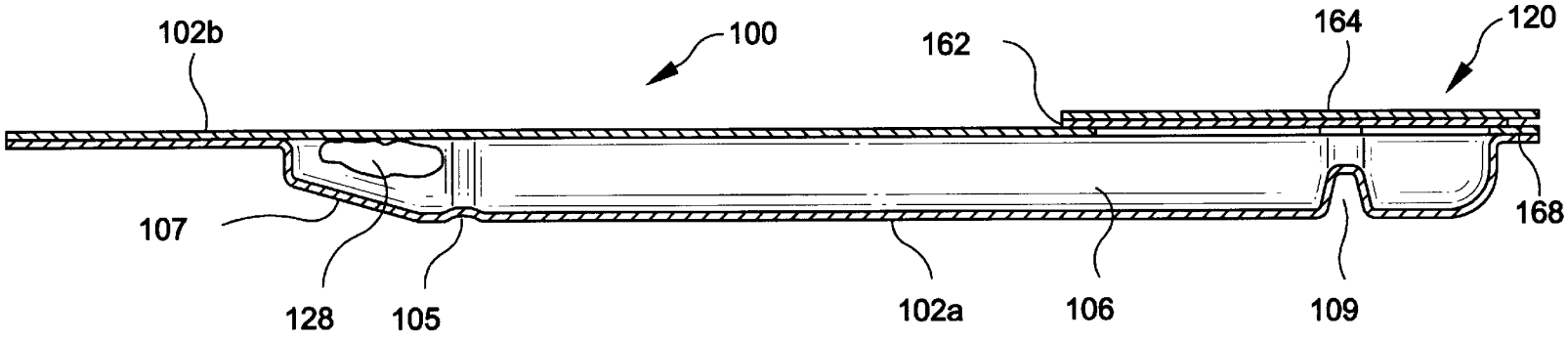
FIG. 8 is a cross-sectional view of an example of a resealable package as shown in FIGS. 1–5, which was manufactured by the apparatus shown in FIG. 7.

Instead of the resealable cover 120 being attached over openings 114 and 116 as shown in FIG. 6, an apparatus 131 as shown in FIG. 7 can be used. The apparatus 131 includes all the features of apparatus 130, but further includes rollers 158 and 160 which feed a two-sided adhesive tape 162 and a cover strip 164, respectively, over the openings 114 and 116 as shown in FIG. 7 to form the resealable cover 120 which is shown, for example, in FIGS. 1–5. That is, the adhesive tape 162 can have an adhesive, such as glue or any other type of pressure sealing material coated on both sides. As illustrated, this two-sided adhesive tape 162 is fed along with the cover material strip 164 to a roller 166, so that the two-sided adhesive tape 162 is sandwiched between the cover strip 164 and the blister backing web 138 which has been joined with the blister web 132. When the punch station 150 punches out the individual packages 100, the cover 120 is formed as shown in FIG. 8 with the two sided adhesive tape 162 and the cover strip 164 being formed in the shape of the cover 120, such that the formed adhesive tape 162 is between the formed cover strip 164 and the lower portion 102*b* of the enclosure 102 of the package 100.

It is noted that the width of adhesive tape 162 can be made smaller than the width of cover strip 164, so that some of the edge of the cover strip 164 does not adhere to the adhesive strip 162. Hence, an unsealed portion 168 of the cover 120 is formed as shown in FIG. 8, which assists in the opening of the cover 120.

Figure 9:
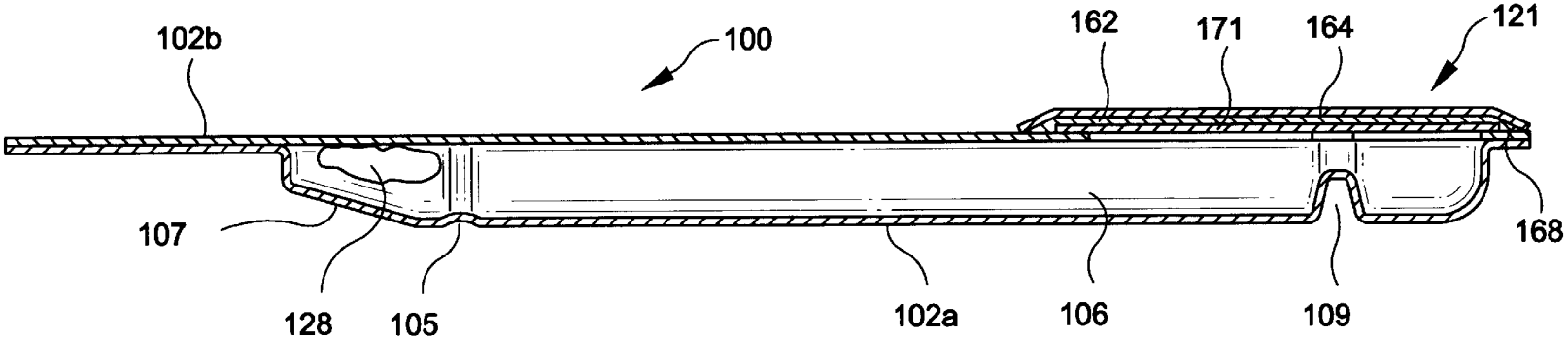
FIG. 9 is a cross-sectional view of an example of a resealable package as shown in FIGS. 1–5, which was manufactured by the apparatus shown in FIG. 7 with a small cover below the resealable cover.

Additionally, as shown in FIG. 7, the apparatus 131 can include a cover placing device 170 which places a small cover 171 over the openings 114 and 116 before the combined adhesive tape 162 and cover strip 164 are laid over the openings 114 and 116. Accordingly, the adhesive tape 162 and cover strip 164 are placed over the small cover 171 to form a resealable cover 121 as shown in FIG. 9. This small cover 171 prevents adhesive from contacting the edges of openings 114 and 116. Hence, when the cover 121 is open to allow, for example, a person to insert his or her finger into the openings 114 and 116 to access the swab 108 (as described in more detail below with regard to FIGS. 10 and 11), the adhesive will not stick to the person's fingers. Furthermore, because the small cover 171 isolates the adhesive tape 162 from the openings 114 and 116, the adhesive does not contact the swab 108 when the swab is stored in either of the cavities 104 or 106. Therefore, the swab does not become contaminated with the adhesive.

Alternatively, instead of using a cover 171, the adhesive tape 162 can have a plurality of holes therein, which can be arranged to each align with a corresponding pair of openings 114 and 116 when the adhesive tape 162 is fed as shown in FIG. 7 to adhere to blister backing web 138 which has been joined with blister web 132. These openings in the adhesive tape 162 thus prevent any portion of the adhesive tape 162 from covering the openings 114 and 116, thereby preventing adhesive from contaminating the edges of the openings 114 and 116, or the swab stored in the cavities 104 or 106.

The preferred method for using the package 100 will now be described with reference to FIGS. 3 and 10–12, in particular.

Figure 10:
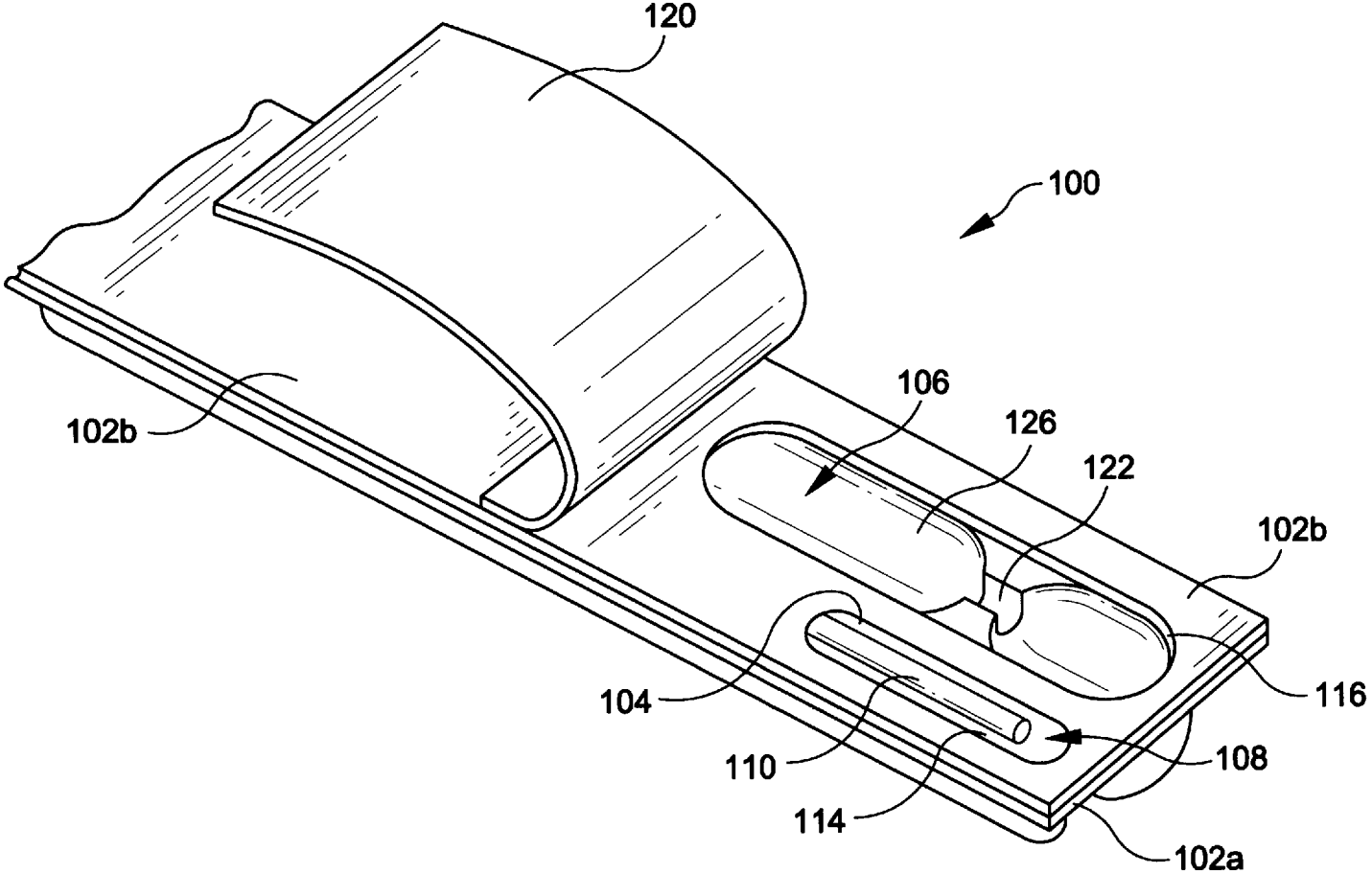
FIG. 10 is a bottom view of the package shown in FIG. 1 with the resealable cover peeled back to expose the openings which provide access to the cavities in the package.
Figure 11:
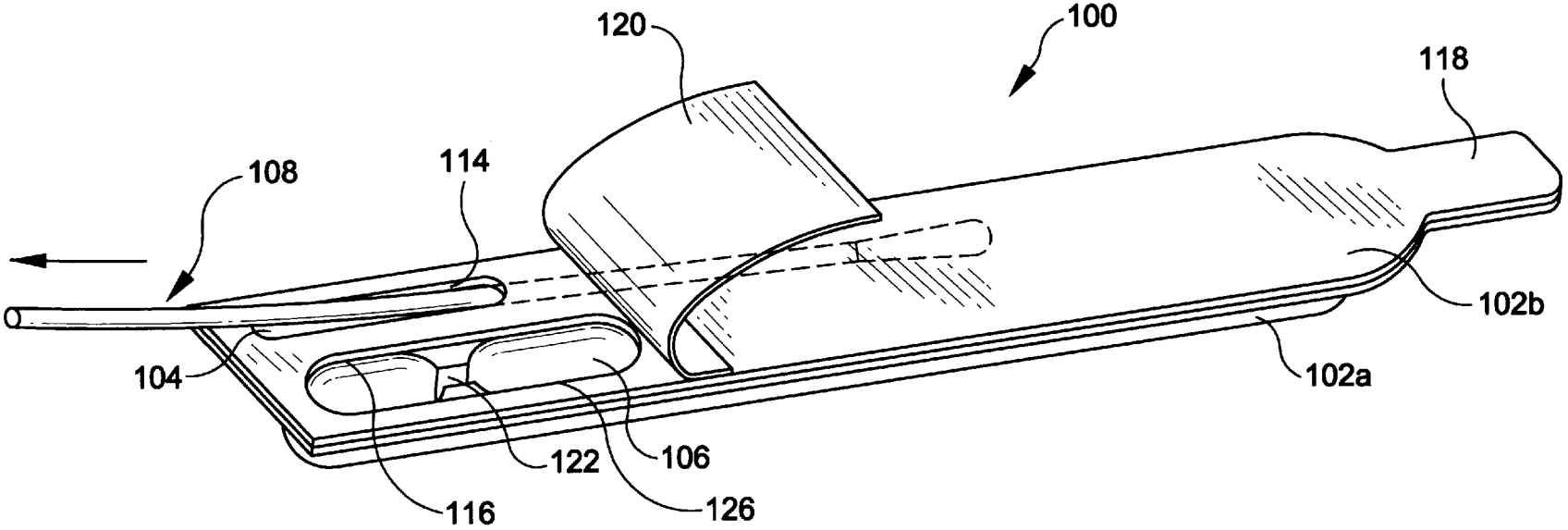
FIG. 11 is a perspective view of the package shown in FIG. 1 showing the swab being removed from the narrow cavity.

When a swab 108 is to be used to collect a sample, such as a mucus sample, urogenital sample, blood sample, or any type of biological or chemical sample, from a patient or any other medium, the cover 120 of package 100 is peeled back to expose openings 114 and 116 as shown, for example, in FIG. 10. The shaft 110 of the swab 108 is then grasped by the user and the swab 108 is pulled out of the cavity 104 through opening 114, as shown specifically in FIG. 11. The user then collects the sample from the patient or medium at the tip 112 of the swab 108. For instance, if the sample is to be taken from a patient's throat, the top 112 of the swab is placed in contact with the patient's throat (e.g., at the back of the patient's mouth) so that mucus adheres to the tip 112. If the sample is to be taken from the patient's urethra, the swab 108 is inserted with the tip 112 first entering the patient's urethra so that fluid and the like adheres to the tip 112 of the swab 108. The swab 108 essentially can be used to collect any type of biological or clinical sample, or can also be used to collect industrial samples, such as soup samples, residue in chicken houses, or for any other practical application.

Figure 2:
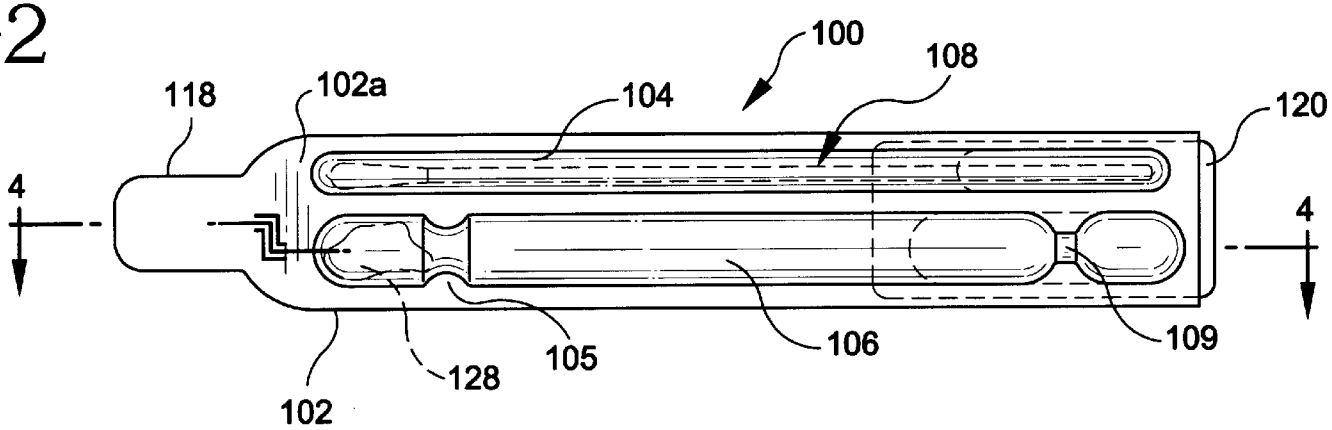
FIG. 2 is atop plan view of the resealable package shown in FIG. 1.
Figure 3:
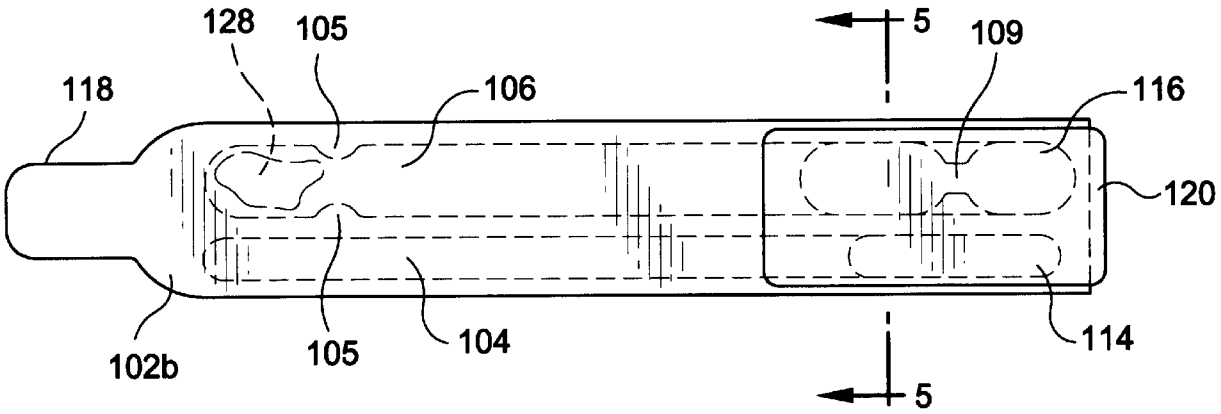
FIG. 3 is a bottom view of the resealable package shown in FIG. 1 with the resealable cover being fully attached.
Figure 4:
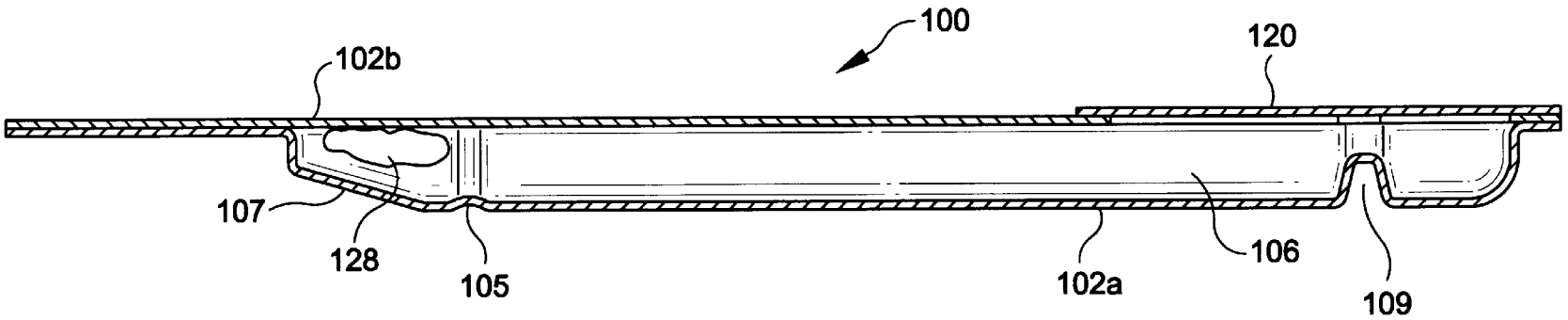
FIG. 4 is an inverted cross-sectional view taken along line 4—4 in FIG. 2.
Figure 5:
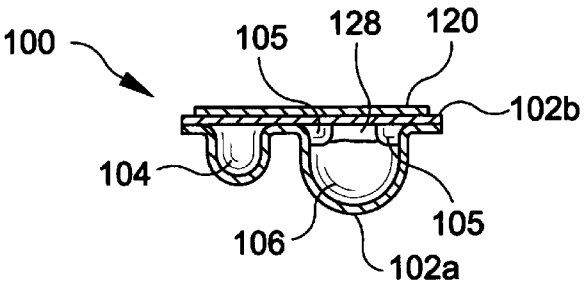
FIG. 5 is a cross-sectional view taken along line 5—5 in FIG. 3.
Figure 12:
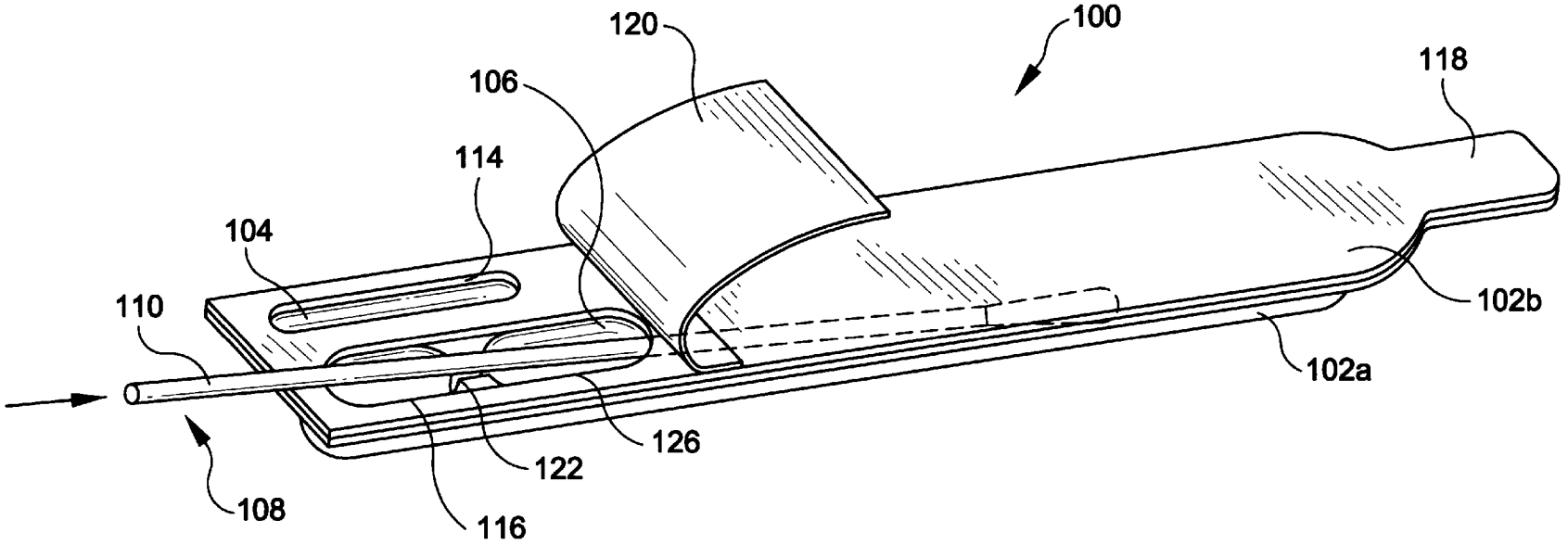
FIG. 12 is a perspective view of the package shown in FIG. 1 showing the swab being inserted into the wide cavity.
Figure 13:
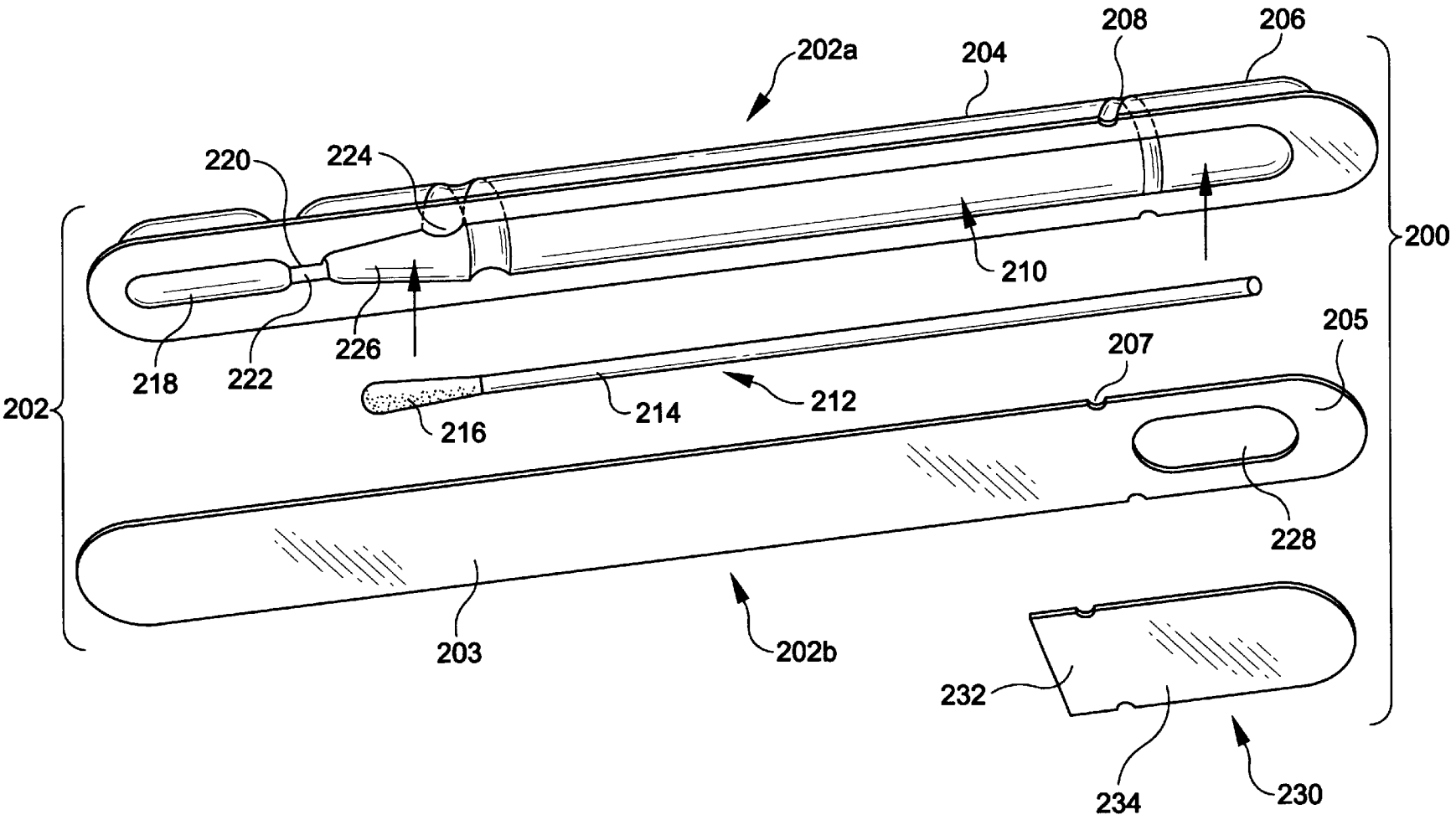
FIG. 13 is a perspective view of a single-cavity resealable blister-type package according to a second embodiment of the present invention.
Figure 14:
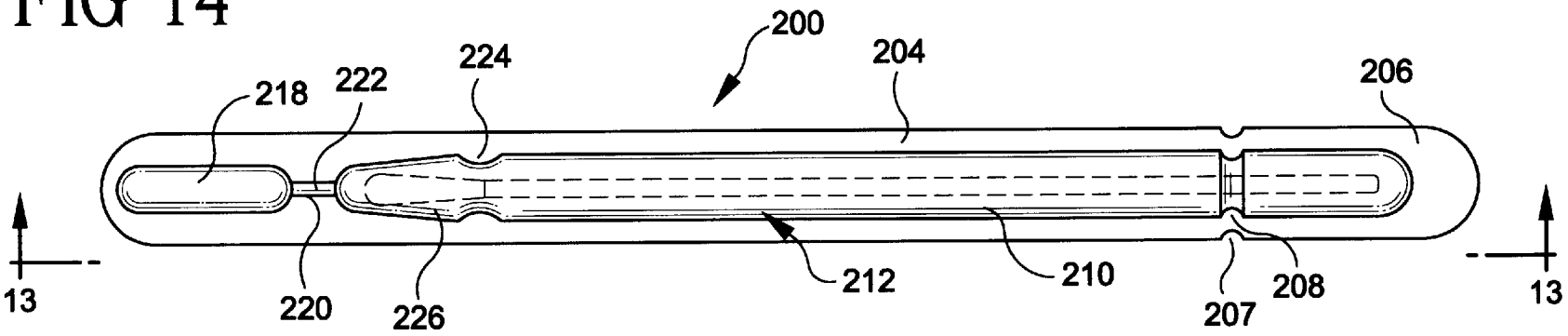
FIG. 14 is a top plan view of the package shown in FIG. 13.

As shown in FIG. 12, the used swab 108 is then reinserted into the cavity 106. The swab 108 is stored in the cavity 106 such that the tip 112 of the swab 108 contacts the pledget 128 so that the medium, such as Stuart's medium, modified Stuart's medium, Amies media or the like, on the pledget 128 will sustain the pathogen, such as a bacteria, collected on the tip 112. Specifically, the slanted portion 107 of the upper portion 102*a* will maintain the tip 112 against the pledget 128. Furthermore, the notched portion 105, as shown in FIG. 2, helps to keep the medium or the pledget 128 from leaking into the remainder of the wide cavity 106. Also, the notched portion 105 prevents the pledget 128 from being removed when the swab 108 is removed from the wide cavity 106. The cover 120 is then resealed over the openings 114 and 116, so that it assumes a position as shown, for example, in FIG. 3. Because the cover 120 and/or bottom of the lower portion 102*b* includes an adhesive material, the cover 120 will be retained on the enclosure 102 when repositioned over the openings 114 and 116 and pressure is applied to it, for example, by the thumb of the user. Accordingly, the cover 120 will maintain the swab 108 in the cavity 106, while also preventing the sample on the tip 112 of the swab 108 from escaping through opening 116.

The package 100 is then transported to a laboratory so that the sample collected on the tip 112 of the swab 108 can be analyzed. When the package 100 is received at the laboratory, a laboratory technician removes the resealable cover 120 from the enclosure 102 so that the cover 120 assumes a position as shown, for example, in FIGS. 10–12. The technician then removes the swab 108 from the wide cavity 106 by grasping the shaft 110 the swab 108. It is noted that the wide portion 126 of the opening 116 allows easy access to the shaft 110 by the technician's fingers. Furthermore, the narrow portion 122 keeps the shaft 110 from moving back and forth across the width of the cavity 106, and thus maintains the swab 108 in a relatively stable position in the cavity 106. In particular, the swab 108 is retained such that its tip 112 remains in contact with the pledget 128 until the swab is removed from the cavity 106.

A blister-type package according to another embodiment of the invention is shown in FIGS. 13–18. Specifically, the package 200 includes an enclosure 202 made of a blister-type material such as plastic or the like. The enclosure 202 includes a tray-like upper portion 202*a* having a first section 204 and a second section 206 that is pivotally coupled to the first portion 204 by a hinge section 208. The hinge section 208 is a portion of the upper portion 202*a* of the enclosure 202 that has undergone, for example, notching or other mechanical conditioning so that it is more flexible than the other sections of the upper portion 202*a*.

The upper portion 202*a* of the enclosure 202 further includes a cavity 210 in which a swab 212 is stored. The cavity 210 can be formed in the upper portion 202*a* by a stamping operation, such as that described above with regard to the apparatus 130 and 131 shown in FIGS. 6 and 7, respectively, and as further discussed with regard to FIGS. 8 and 9. Like the swab 108 described above, swab 212 includes a shaft 214 and a tip 216 made of Dacron, rayon or any other suitable material.

The upper portion 202*a* further includes a medium cavity 218 in which is stored a medium material such as Stuart's medium, modified Stuart's medium, Amies media or the like. The medium cavity 218 is in communication with the swab cavity 210 through a channel 220. The channel 220 is initially sealed with a rupturable seal 222 to prevent the medium stored in medium cavity 218 from entering the swab cavity 210. As further illustrated, the walls defining swab cavity 210 include notches 224 which form a well section 226 of the cavity which will be described in more detail below.

The enclosure 202 further includes a lower portion 202*b* that is made of a material identical or similar to that of the upper portion 202*a*. The lower portion 202*b* is attached to the upper portion 202*a* by a heat stamping process or in any other suitable manner.

Figure 15:
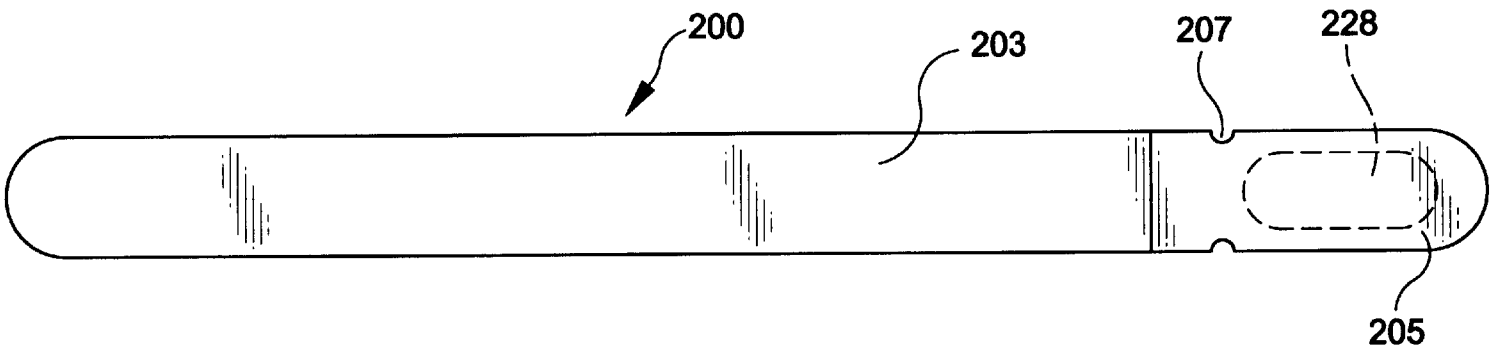
FIG. 15 is a bottom view of the package shown in FIG. 13.
Figure 17:
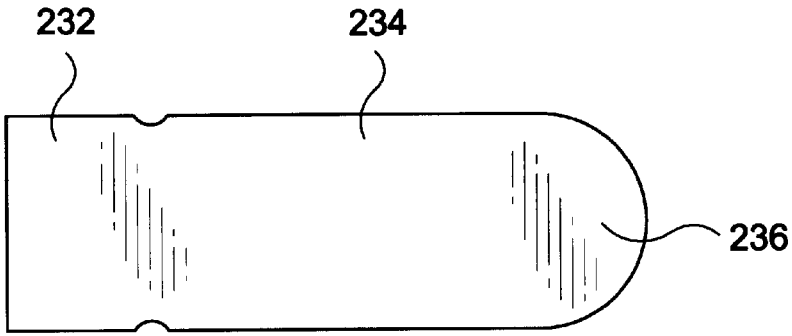
FIG. 17 is a detailed view of the resealable cover of the package shown in FIG. 14.

The lower portion 202*b* of the enclosure 202 includes a first section 203 and a second section 205 that are separated by a hinge section 207 which is similar to hinge section 208 in that it is more flexible than the other sections 203 and 205 of the bottom portion 202*b*. The section 205 of bottom portion 202*b* includes an opening 228 that allows access to the cavity 210. A resealable cover 230 is attached to the lower portion 202*b* enclosure 202 over the opening 228. Specifically, the resealable cover 230 includes a portion 232 that is permanently or substantially permanently attached to the lower portion 202*b* of the enclosure 202, and a portion 234 that is releasably attached to the lower portion 202*b* of the enclosure 202 by a resealable adhesive or the like. As shown in FIG. 17 in particular, the resealable cover 230 can be shaped so that a gripping portion 236 on the bottom portion 202*b* of the enclosure 202 is not covered by the adhesive. The gripping portion 236 can be grasped by the user to separate the portion 234 of cover 230 from the enclosure 202 and thus expose the opening 228, which is shown in FIG. 15.

Figure 18:
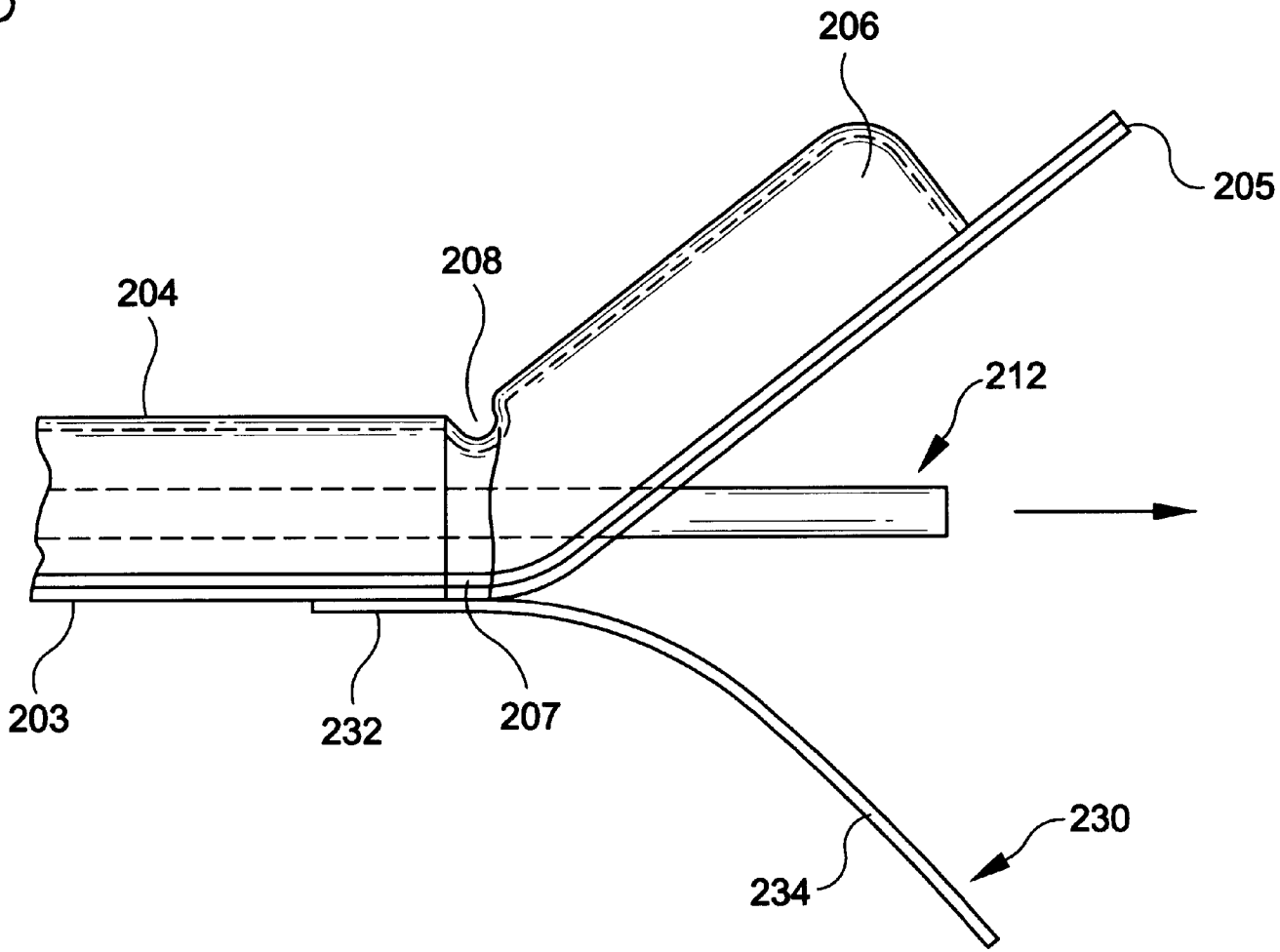
FIG. 18 is a detailed side view of the package shown in FIG. 14 with the hinged portion of the package being pivoted to allow access to the swab.

As shown in FIG. 18, the portion 234 of the cover 230 can be separated from the bottom portion 202*b* of the enclosure 202 to expose the shaft 214 of the swab 212. It is noted that the hinge section 207 the bottom portion 202*b* of the enclosure 202 aligns or substantially aligns with hinge section 208 of the upper portion 202*a*. Hence, the section 206 of the upper portion 202*a* and the section 205 of the lower portion 202*b*,which are attached to each other as described above, pivot about hinge sections 207 and 208 with respect to the remaining portions 203 and 204 of the lower 202*b* and upper 202*a* portions, respectively, of enclosure 202. The user can then remove the swab 212 from the cavity 210 and use the swab to collect a sample in the manner described above. The swab can then be reinserted into the cavity 210 when the portion 234 of the cover 230 and the portions 205 and 206 of the enclosure 202 are positioned as shown. The portion 234 can then be reattached to the bottom of section 205 of the lower portion 202*b* of the enclosure 202, so that the portion 234 of the cover 230 again closes the opening 228. In this condition, the swab 212 is resealed in the cavity 210.

Figure 16:
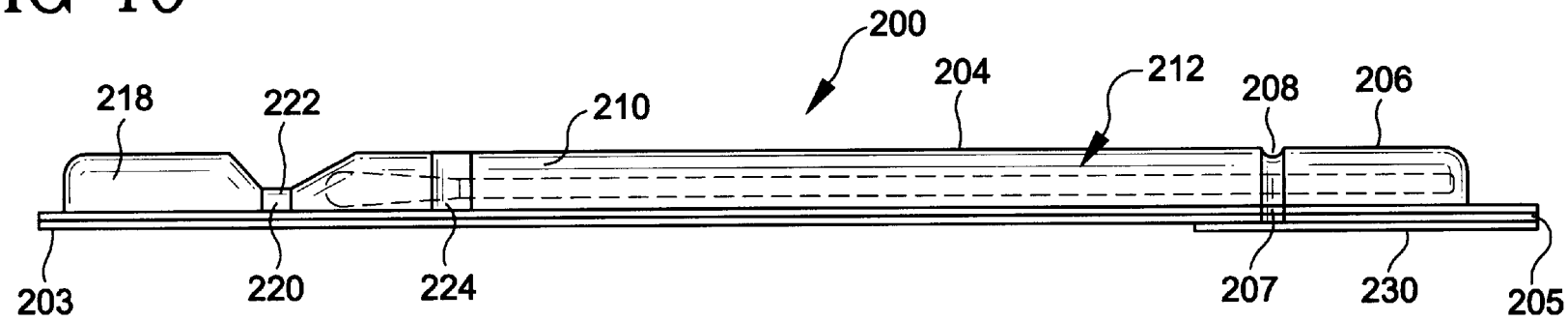
FIG. 16 is a side view taken along line 16—16 in FIG. 14.

The user can then apply thumb pressure to the medium cavity 218, which is shown in FIG. 16, causing the rupturable seal 222 to break and thus allowing the medium stored in cavity 218 to flow through the channel 220 into the well 226 of the cavity 210. Indents 224 help to maintain the medium in the well 226 and thus, prevent or substantially prevent any medium from entering the remainder of the cavity 210 and contaminating the shaft 214 of the swab 212. Accordingly, the tip 216 of the swab becomes immersed in the medium, which sustains the pathogen collected on the tip 216.

The package 200 can then be transported to a laboratory, for example, so that the sample collected on tip 216 of the swab 212 can be tested. At the laboratory, a lab technician can separate the portion 234 of the receivable cover 230 from the bottom of section 205 of the enclosure 202 as shown, for example, in FIG. 18, and remove the swab 212 from the cavity 210. The sample on the tip of the swab 216 can then be tested for the presence of a bacterium or other pathogen(s).

It is noted that, although not specifically shown, the upper portion 102*a* of enclosure 102 of the package 100 shown in FIG. 1 can be separated into a first portion and a second portion by a hinge member similar to hinge member 208, and the lower portion 102*b* can be separated into first and second portions by a hinge member similar to hinge member 207, to form a hinged portion of the enclosure 102 which can pivot with respect to the remainder of the enclosure 102 in a manner similar to that described above for the package 200, thus allowing easier access to the cavities 104 and 106 through openings 114 and 116, respectively. Furthermore, instead of or in addition to a pledget 128 being disposed in the cavity 106, the embodiment shown in FIG. 1 can include a medium cavity similar to medium cavity 218 that is in communication with the cavity 106 via a channel having a rupturable seal disposed therein. The seal can then be broken after the used swab 108 has been inserted in the cavity 106 to allow the medium to flow from the media cavity through the channel into the cavity 106. The walls forming the cavity 106 can further include indents similar to indents 224 to form a well at the end of the cavity 106 at which the tip 112 of the swab 108 is positioned when the swab 108 is inserted in the cavity 106.

Figure 19:
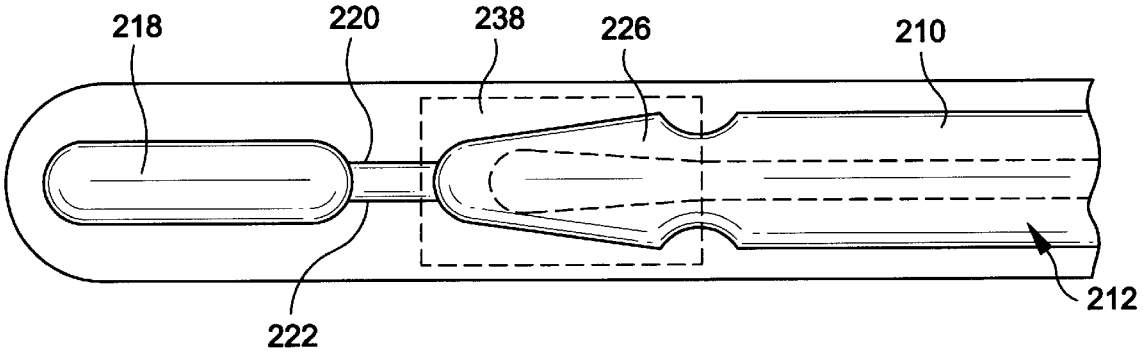
FIG. 19 is a detailed breakaway view showing an alternate embodiment of the swab cavity of the package shown in FIG. 14.

Further variations of the embodiments described above are shown in FIGS. 19–22. Specifically, as shown in FIG. 19, the package 200 can further include a filter paper 238, made of an absorbing material, that is disposed in the well 226 and thus helps to retain the medium in the well 226.

Figure 20:
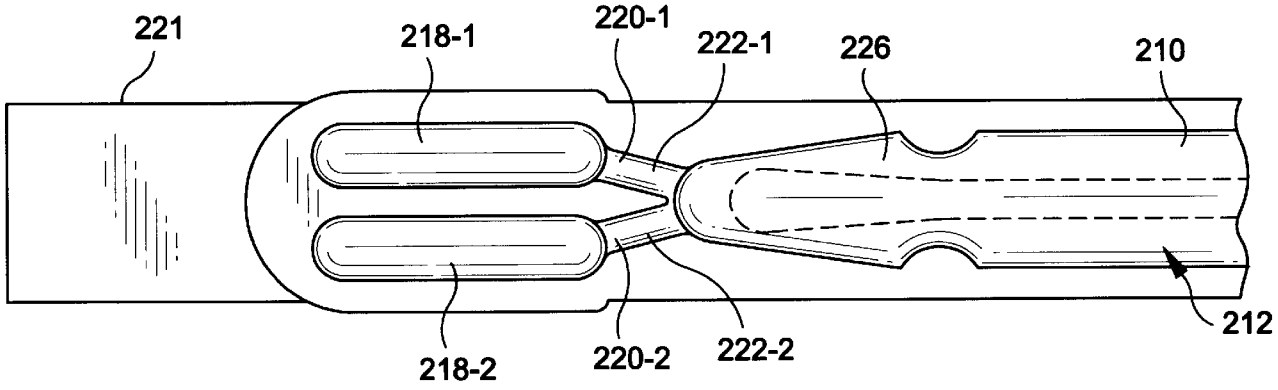
FIG. 20 is another detailed breakaway view showing the package illustrated in FIG. 14 with multiple medium cavities.

As shown in FIG. 20, the upper enclosure 202 can include two medium cavities 218-1 and 218-2 that are in communication with the well 226 via channels 220-1 and 220-2, respectively. In this event, since the width of the package 200 may be increased to accommodate the two media cavities, the package 200 can include a narrow extended portion 221 which, like portion 118, can be inserted into the hole of a tube rack to position the package 200 upright. The channels 220-1 and 220-2 include rupturable seals 222-1 and 222-2, respectively, which function similarly to the seal 222 described above. Hence, in the variation shown in FIG. 20, two types of media stored in medium cavities 218-1 and 218-2 can be applied to the tip 216 of the swab 212. Also, the package 100 shown in FIG. 1 can be modified to include the multiple media cavities 218-1 and 218-2, channels 220-1 and 220-2, and seals 222-1 and 222-2 to provide two types of media to the tip 112 of the swab 108 when swab 108 is stored in the cavity 106.

Figure 21:
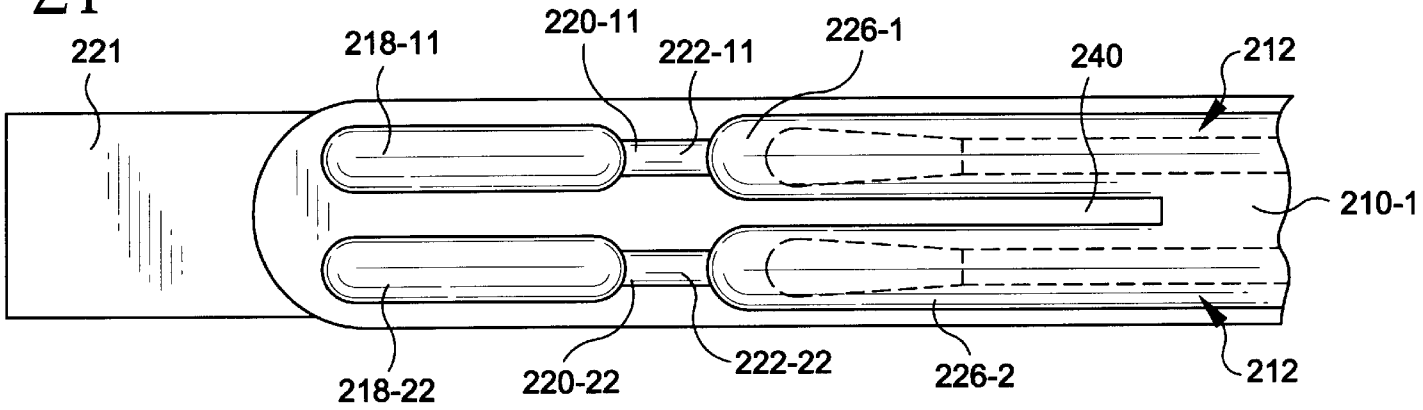
FIG. 21 is a further detailed breakaway view of a package as shown in FIG. 14, modified to include two cavities for storing two sample collecting swabs.

As shown in FIG. 21, the size of the cavity 210-1 can be modified to accommodate two swabs 212. In this arrangement, a divider 240 extends into the cavity 210-1 and thus provides a separation wall between the tips 216 of the swabs 212. As illustrated, the enclosure 202 can include two medium cavities 218-11 and 218-22 that are in communication with respective wells 226-1 and 226-2 of the cavity 210-1 by channels 220-11 and 220-22, respectively. The channels 220-11 and 220-22 include rupturable seals 222-11 and 222-22, respectively, which operate similarly to the seal 222 described above. That is, when the seals 222-11 and 222-22 are ruptured, the media in media cavities 218-11 and 218-22 flow through their respective channels 220-11 and 220-22 into wells 226-1 and 226-2, respectively. The divider 240 prevents or substantially prevents the medium in well 226-1 from flowing into well 226-2 and vice-versa. The package 100 shown in FIG. 1 can also be modified so that the cavity 106 includes a divider 240 and is thus capable of accommodating two swabs 108, with two medium cavities 218-11 and 218-22 providing the same or different media to the respective swabs. It is also noted that in the packages 100 and 200, and any modification thereof, the divider 240 could extend the entire length of the cavity 106 (package 100) or 210-1 (package 200), to prevent cross contamination of the two media and specimens upon removing the swabs and specimens from the packages.

Figure 22:
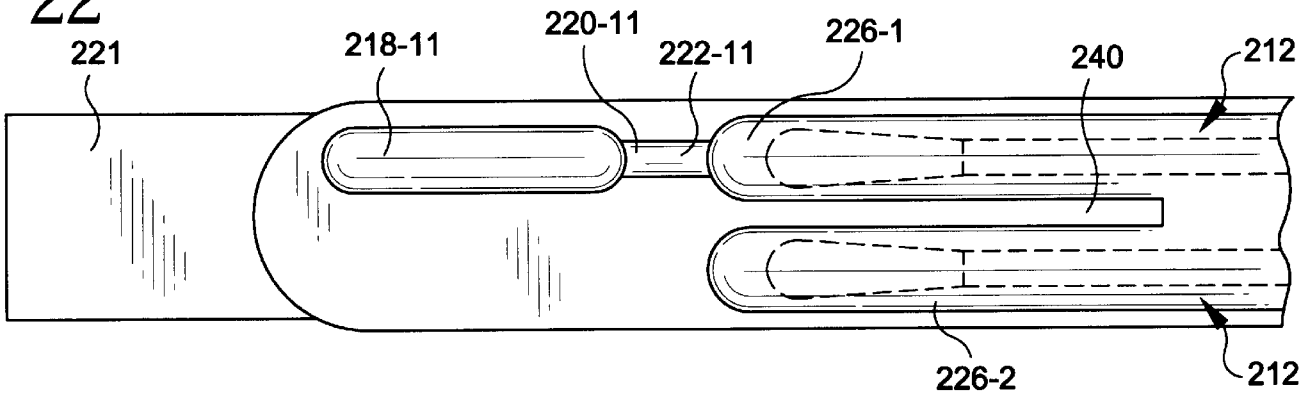
FIG. 22 is another detailed breakaway view illustrating a two-cavity embodiment as shown in FIG. 21 with a single medium cavity associated with one of the swab cavities.

Alternatively, as shown in FIG. 22, only one media cavity 218-11 may be present to provide a medium through channel 220-11 into well 226-1, and thus, only onto tip 216-1 of swab 212-1. Furthermore, as with the package 100 shown in FIGS. 1–5, the package 200 can have any number of swab holding cavities and media cavities.

Although only a few exemplary embodiments of the invention have been described in detail above, those skilled in the art will readily appreciate that many modifications are possible in the exemplary embodiments without materially departing from the novel teachings and advantages of this invention. Accordingly, all such modifications are intended to be included within the scope of the invention as defined in the following claims.

What is claimed is:

1. An apparatus for storing and transporting a sampling device used to collect a biological or chemical sample, comprising:

an enclosure having first and second cavities therein which are accessible through at least one opening in the enclosure, the first cavity being configured to store the sampling device in an unused condition prior to the sampling device being used to collect the biological sample, and the second cavity being configured to store the sampling device in a used condition after the sampling device is used to collect the biological sample and comprising a medium disposed therein positioned to contact the biological sample when the sampling device is stored therein; and a cover, carried by the enclosure, and being positionable in a first orientation in which the cover blocks access to the first and second cavities through the at least one opening, and in a second orientation in which the cover permits access to the first and second cavities through the at least one opening.

2. An apparatus as claimed in claim 1, wherein at least a portion of the cover is releasable from the enclosure to allow access to the first and second cavities through the at least one opening.

3. An apparatus as claimed in claim 2, further comprising an adhesive which releasably secures said portion of the cover to the enclosure.

4. An apparatus as claimed in claim 1, wherein said at least one opening comprises a first opening in communication with the first cavity, and a second opening in communication with the second cavity.

5. An apparatus as claimed in claim 4, wherein the second opening has a first portion having a width substantially the same as that of the second cavity, and a second portion having a width less than that of the second cavity.

6. An apparatus as claimed in claim 1, wherein the enclosure comprises an extension member at one end thereof, said extension member having a width less than that of the enclosure.

7. An apparatus as claimed in claim 1, wherein the width of the first cavity is less than the width of the second cavity.

8. An apparatus for storing and transporting a sampling device used to gather a biological sample, comprising:

an enclosure having at least one cavity therein which is configured to store the sampling device, the enclosure comprising a first section including a first portion of said at least one cavity and a second section including a second portion of said at least one cavity, the second section being pivotally coupled to the first section; and a cover, carried by the enclosure, and having a portion that is positionable in a closed configuration in relation to the second section to block access to said at least one cavity, and in an open configuration in relation to the second section to permit access to said at least one cavity.

9. An apparatus as claimed in claim 8, wherein the enclosure further comprises at least one medium delivery portion comprising:

a medium storage well having a medium therein;

a passage providing communication between the medium storage well and said at least one cavity; and a rupturable member, disposed in the passage, which is configured to substantially block the medium from passing through the passage from the medium storage well to said at least one cavity when in an intact state, and to permit the medium to pass through the passage from the medium storage well to said at least one cavity when in a ruptured state.

10. An apparatus as claimed in claim 9, further comprising a plurality of said medium delivery portions.

11. An apparatus as claimed in claim 9, wherein the enclosure comprises:

a plurality of said cavities; and a plurality of said medium delivery portions, each being configured to deliver a respective medium to a respective one of said cavities.

12. An apparatus as claimed in claim 8, wherein the first section further comprises a plurality of projections, extending into said first portion of said at least one cavity, to form a well portion in said at least one cavity at an end thereof, the well portion being configured to retain a medium therein while substantially preventing the medium from entering the remainder of the cavity.

13. A method for storing and transporting a sampling device used to collect a biological sample, comprising the steps of:

providing a resealable package having first and second cavities therein, with the sampling device being stored in the first cavity and a resealable cover being disposed over at least one opening through which the first and second cavities are accessed;

moving the resealable cover to expose said at least one opening to provide access to the first cavity, and removing the sampling device therefrom;

inserting the sampling device into the second cavity; and resealing the resealable cover over said at least one opening to substantially seal the sampling device in the second cavity.

14. A method as claimed in claim 13, further comprising the step of:

using the sampling device to collect a biological sample after removing the sampling device from the first cavity and before inserting the sampling device into the second cavity.

15. A method as claimed in claim 13, further comprising the step of:

a medium in the second cavity; and wherein the inserting step comprises the step of positioning the sampling device in the second cavity such that a portion of the sampling device contacts the medium.

16. A method as claimed in claim 13, wherein the providing step comprises the step of providing the resealable package such that the first cavity has a width less than that of the second cavity.

17. A method for storing and transporting a sampling device used to collect a biological sample, comprising the steps of:

providing a resealable package comprising an enclosure having first and second sections coupled together by a hinge section, and a cavity therein extending into the first and second sections, with the sampling device being stored in the cavity and a resealable cover being disposed over an opening through which the cavity is accessed;

pivoting the second section about the hinge section with respect to the first section, while positioning the resealable cover to expose the opening to provide access to the cavity;

removing the sampling device from the cavity;

reinserting the sampling device into the cavity from which it was removed in the removing step; and resealing the resealable cover over the opening to reseal the sampling device in the cavity.

18. A method as claimed in claim 17, further comprising the step of:

using the sampling device to collect a biological sample after removing the sampling device from the first cavity and before reinserting the sampling device into the first cavity.

19. A method as claimed in claim 17, wherein the providing step comprises the step of:

providing, in the resealable package, at least one medium delivery portion comprising:

a medium storage well having a medium therein; and a rupturable member which is configured to substantially block the medium from passing from the medium storage well to the cavity when in an unruptured state; and wherein the method further comprises the step of:

after performing the resealing step, rupturing the rupturable member to allow the medium to pass from the medium storage well to the cavity.

* * * * *